US012171345B2

(12) United States Patent
Walker

(10) Patent No.: US 12,171,345 B2
(45) Date of Patent: Dec. 24, 2024

(54) PRODUCT PUSHER WITH MANUAL ACTUATOR

(71) Applicant: Fasteners for Retail, Inc., Twinsburg, OH (US)

(72) Inventor: William H. Walker, Fairlawn, OH (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

(21) Appl. No.: 18/304,835

(22) Filed: Apr. 21, 2023

(65) Prior Publication Data

US 2023/0337839 A1 Oct. 26, 2023

Related U.S. Application Data

(60) Provisional application No. 63/363,402, filed on Apr. 22, 2022.

(51) Int. Cl.
*A47F 1/12* (2006.01)

(52) U.S. Cl.
CPC ..... *A47F 1/126* (2013.01)

(58) Field of Classification Search
CPC ..... A47F 1/125; A47F 1/126
USPC ..... 211/59.2, 59.3
See application file for complete search history.

(56) References Cited

U.S. PATENT DOCUMENTS 2,079,754 A * 5/1937 William, V ..... A47F 1/125 211/59.3
2,098,844 A * 11/1937 William, V ..... A47B 81/007 211/59.3
5,123,546 A * 6/1992 Crum ..... A47F 1/126 206/556
5,411,146 A * 5/1995 Jarecki ..... A47F 5/0056 211/184
5,413,229 A * 5/1995 Zuberbuhler ..... A47F 1/125 211/59.3
5,469,976 A * 11/1995 Burchell ..... A47F 1/125 211/59.3
5,613,621 A * 3/1997 Gervasi ..... G07F 11/38 221/6
6,375,015 B1 * 4/2002 Wingate ..... A47F 1/126 211/59.3
6,527,127 B2 * 3/2003 Dumontet ..... A47F 1/125 211/59.3
8,113,360 B2 * 2/2012 Olson ..... A47F 5/005 211/59.3

(Continued)

FOREIGN PATENT DOCUMENTS

EP 3741264 B1 2/2022

*Primary Examiner* — Jennifer E. Novosad
(74) *Attorney, Agent, or Firm* — Honigman LLP

(57) ABSTRACT

A merchandising system includes a track extending from a first end to a second end. The merchandising system further includes a primary pusher slidably attached to the track between the first end and the second end. The merchandising system further includes a secondary pusher slidably attached to the track and operable to bias the primary pusher towards the first end. The merchandising system includes an actuator operable to bias the secondary pusher along the track. The actuator is connected to the secondary pusher and includes a grip disposed at the first end of the track for selectively biasing the secondary pusher along the track.

19 Claims, 19 Drawing Sheets

(56) References Cited

U.S. PATENT DOCUMENTS

| | | | | |
|---|---|---|---|---|
| 8,941,495 | B2 * | 1/2015 | Wiese | G08B 13/08 340/568.8 |
| 8,997,997 | B2 * | 4/2015 | Close | A47F 1/125 206/804 |
| 9,232,864 | B2 * | 1/2016 | Hardy | A47B 87/0246 |
| 9,265,362 | B2 * | 2/2016 | Hardy | A47F 1/125 |
| 10,959,541 | B2 * | 3/2021 | Everett | A47F 1/126 |
| 2005/0098515 | A1 * | 5/2005 | Close | A47F 7/28 211/59.3 |
| 2012/0118840 | A1 * | 5/2012 | Howley | A47F 1/126 211/59.3 |
| 2015/0041418 | A1 * | 2/2015 | Grubbs | A47F 1/126 211/59.3 |
| 2023/0200562 | A1 * | 6/2023 | Goehring | A47F 5/005 211/59.2 |
| 2023/0337839 | A1 * | 10/2023 | Walker | A47F 1/126 |

* cited by examiner

PRODUCT PUSHER WITH MANUAL ACTUATOR

CROSS REFERENCE TO RELATED APPLICATIONS

This application claims priority under 35 U.S.C. § 119(e) to U.S. Provisional Application 63/363,402, filed on Apr. 22, 2022. The disclosure of this prior application is considered part of the disclosure of this application and is hereby incorporated by reference in its entirety.

FIELD

The present disclosure relates generally to a product pusher with a manual actuator.

BACKGROUND

This section provides background information related to the present disclosure and is not necessarily prior art.

Shelving is used extensively for stocking and storing products or merchandise in a variety of stores. Such stores often use a forward feed device to control the storage and distribution of such products. In particular, the forward feed devices are used to automatically move merchandise forward on a shelf after an item is removed. In some instances, the forward feed device moves the merchandise forward at a speed that cause undesirable disruption to the merchandise remaining on the shelf. Accordingly, while known forward feed devices have proven useful for their intended purpose, a need for continuous improvement in the pertinent art remains.

BRIEF DESCRIPTION OF THE DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
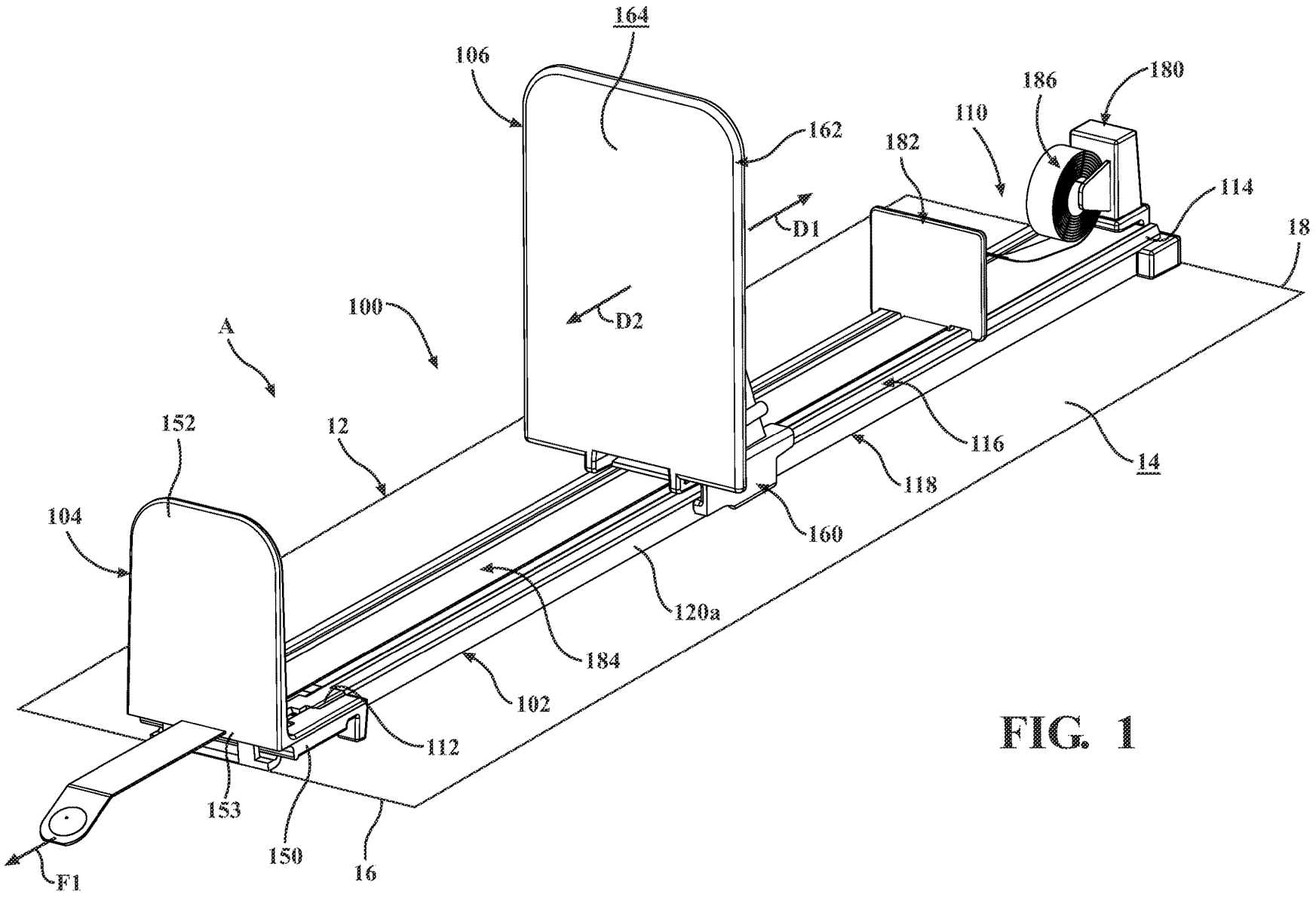
FIG. 1 is a front perspective view of a merchandising system in a retail environment according to the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

An aspect of the disclosure provides a merchandising system including a track extending from a first end to a second end. The merchandising system further includes a primary pusher slidably attached to the track between the first end and the second end. The merchandising system further includes a secondary pusher slidably attached to the track and operable to bias the primary pusher towards the first end.

Aspects of the disclosure may include one or more of the following optional features. In some implementations, the merchandising system includes an actuator operable to bias the secondary pusher along the track. In some configurations, the actuator is connected to the secondary pusher and includes a grip disposed at the first end of the track. In some example, the merchandising system includes a front stopper wall disposed at the first end of the track. In some configurations, the actuator is received within the track. In some implementations, the actuator extends between the track and the primary pusher.

In some examples, the primary pusher is operable to translate along the track independently from the secondary pusher. In some implementations, the merchandising system includes a retraction member operable to continuously bias the secondary pusher towards the second end of the track. In some examples, the retraction member includes a spring having a first end attached to the secondary pusher and a second end attached to the track. In some configurations, the retraction member includes a stanchion attached to the track, the second end of the spring being attached to the stanchion.

Another aspect of the disclosure provides a merchandising system including a track extending from a first end to a second end. The merchandising system includes a primary pusher slidably attached to the track between the first end and the second end. The merchandising system further includes an actuator disposed at the first end of the track and operable to selectively bias the primary pusher along the track between the first end and the second end.

Aspects of the disclosure may include one or more of the following optional features. In some examples, the merchandising system includes a secondary pusher slidably attached to the track and connected to the actuator. In some examples, the actuator includes a grip disposed at the first end of the track.

In some implementations, the merchandising system includes a front stopper wall disposed at the first end of the track. In some configurations, the actuator is received within the track. In some examples, wherein the actuator extends between the track and the primary pusher. In some configurations, the primary pusher is operable to translate along the track independently from the actuator.

In some examples, the merchandising system includes a retraction member operable to continuously bias the actuator to a retracted position within the track. In some configurations, the retraction member includes a spring having a first end attached to the actuator and a second end attached to the track. Optionally the retraction member includes a stanchion attached to the track, the second end of the spring being attached to the stanchion.

Referring to FIG. 1, a merchandising system 100 is generally shown. The merchandising system 100 may be installed on a top surface 14 of a shelf 12, or other suitable base surface. The shelf 12 may be located in a store or other suitable location where consumers are able to purchase merchandise. As shown in FIG. 1, the top surface 14 of the shelf 12 extends from a front edge 16 to an opposite rear edge 18. As discussed throughout, the direction from the front edge 16 to the rear edge 18 defines a longitudinal direction while the direction parallel to the front edge 16 and the rear edge 18 defines a lateral direction. In some implementations, the shelf 12 may include apertures 20 extending through the top surface 14 and arranged in series adjacent to each of the front edge 16 and the rear edge 18 of the shelf 12. Portions of the merchandising system 100 may be secured to the shelf 12 via fasteners engaging with the apertures 20. The merchandising system 100 may be secured to the shelf 12 in any suitable manner, and the merchandising system 100 may be selectively detached from the shelf 12 and moved, for example, to another shelf or other surface.

With reference to FIG. 1, the merchandising system 100 includes an elongate track 102, a front stopper 104 disposed at a first end of the track 102, a primary pusher 106 operable to translate along the track 102, and a puller system 110 attached to the track 102 and operable to selectively bias the primary pusher 106 towards the front stopper 104 disposed at the first end of the track 102. As described in greater detail below, the merchandising system 100 is generally configured so that the puller system 110 can be operated by a user (e.g., a store associate) to advance the primary pusher 106 towards the front stopper 104 so that products that are maintained on the shelf are maintained at a forward-most position on the shelf, thereby enhancing product visibility and access to potential customers.

Figure 2:
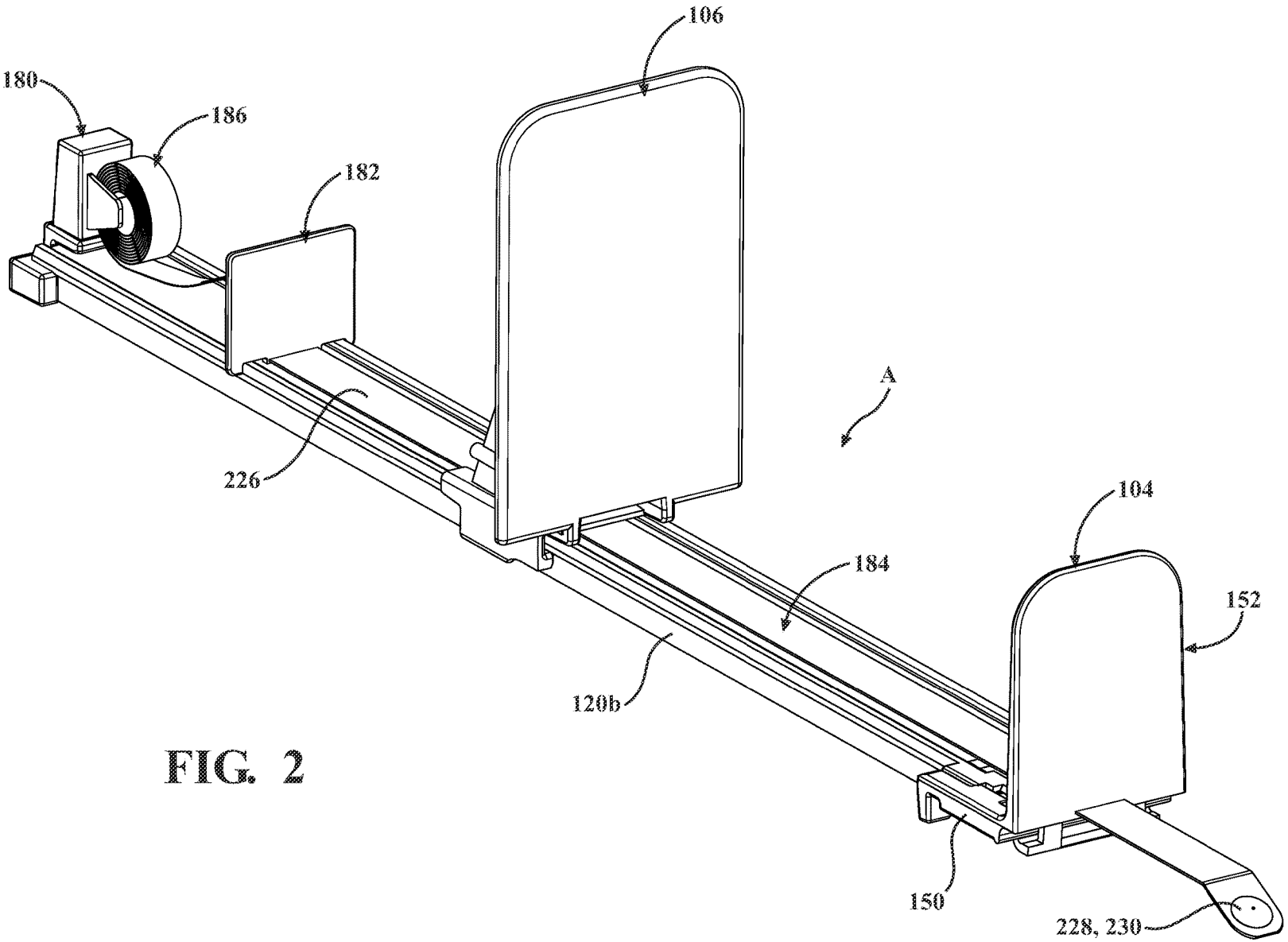
FIG. 2 is a front perspective view of the merchandising system of FIG. 1.
Figure 3:
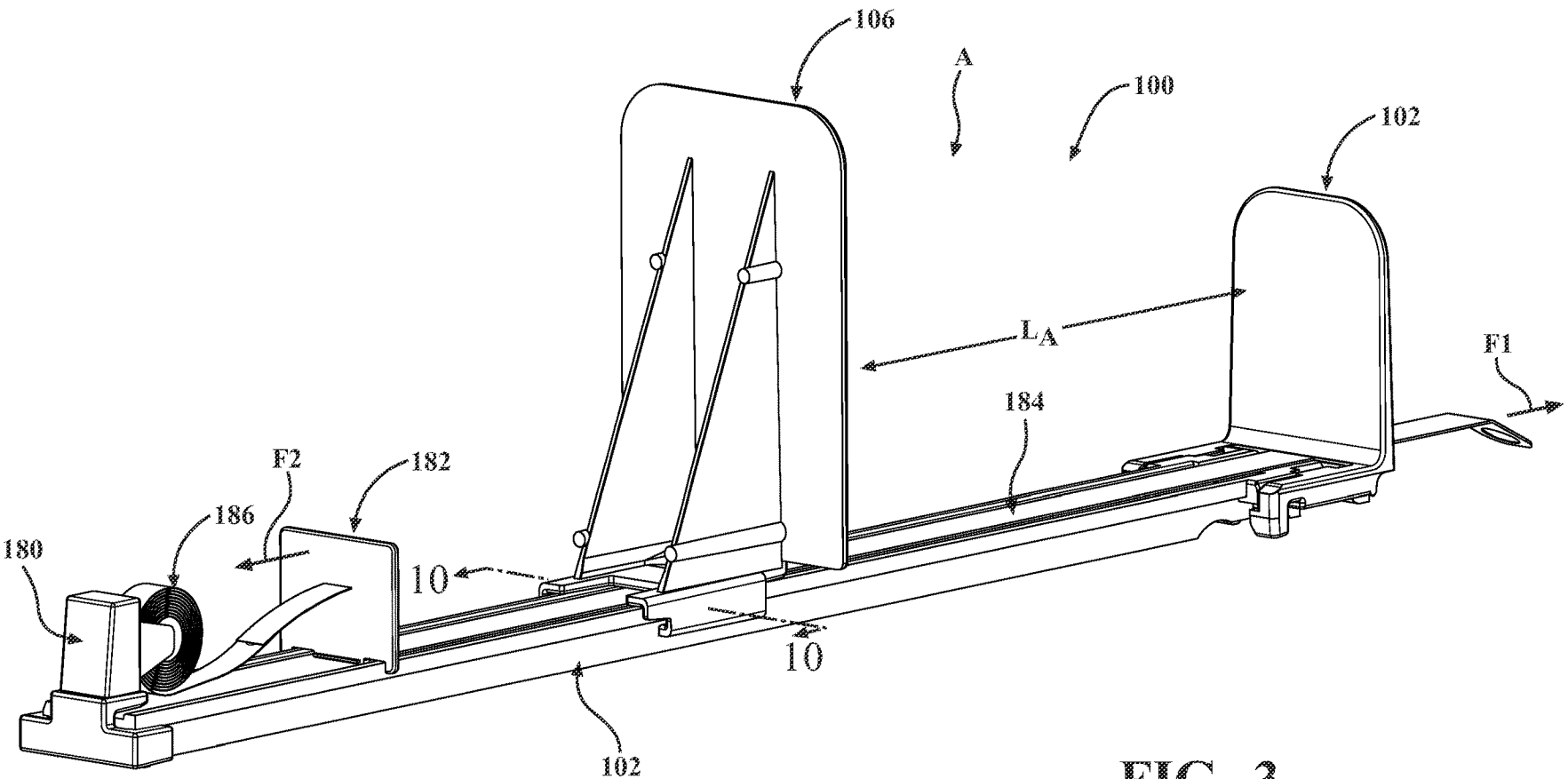
FIG. 3 is a rear perspective view of the merchandising system of FIG. 1.
Figure 4:
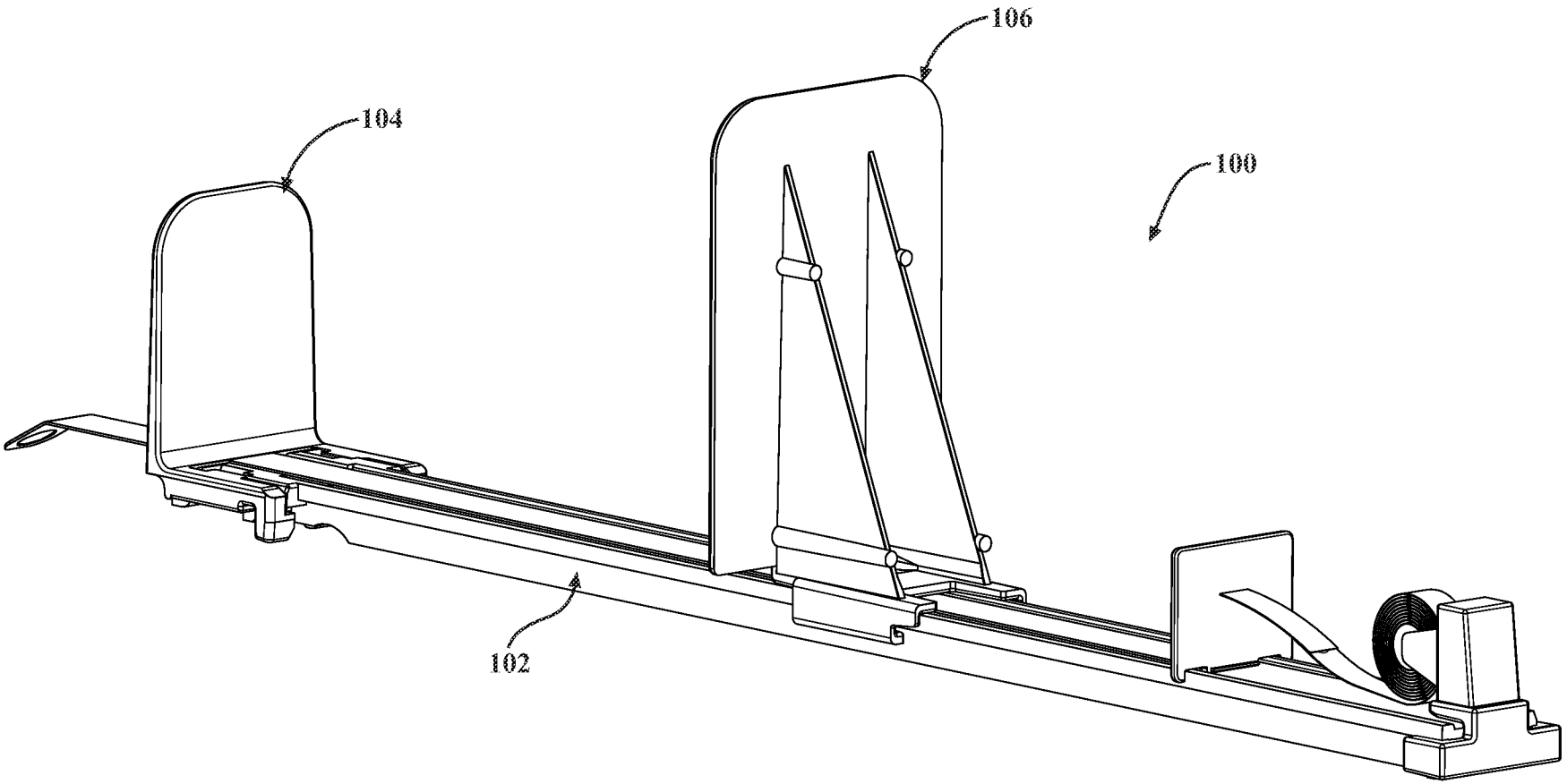
FIG. 4 is a rear perspective view of the merchandising system of FIG. 1.
Figure 5:
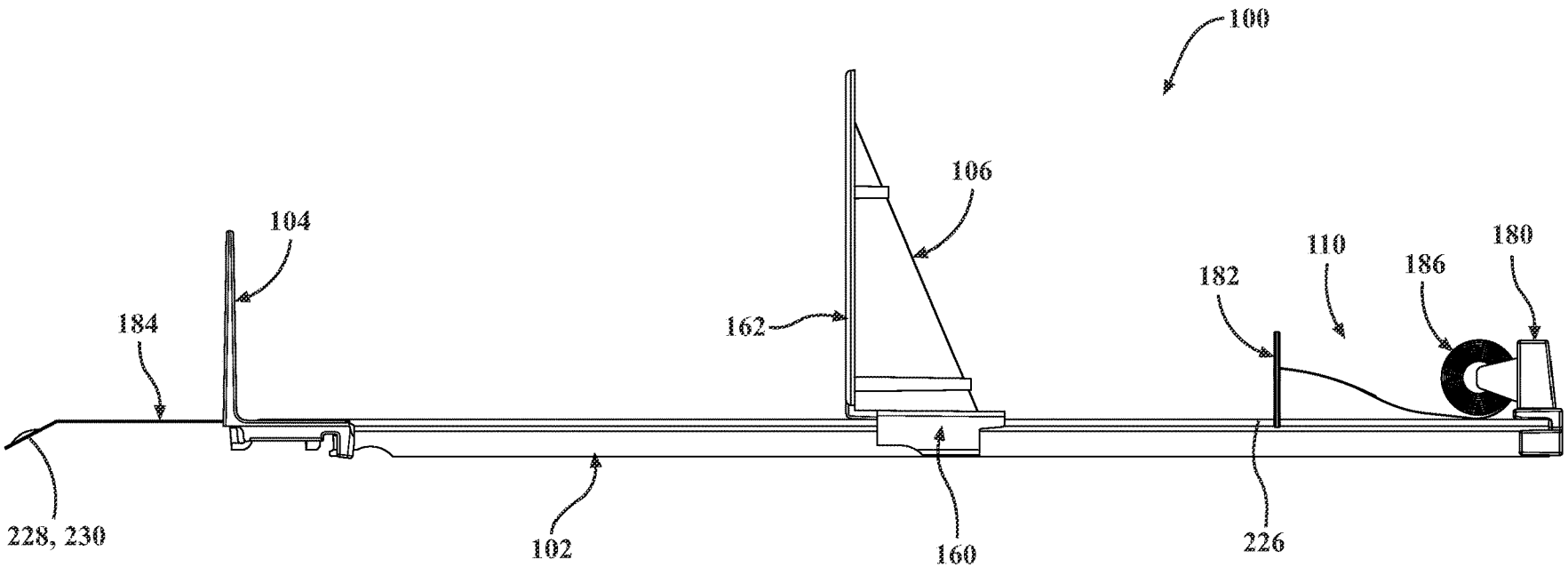
FIG. 5 is a side elevation view of the merchandising system of FIG. 1.
Figure 7:
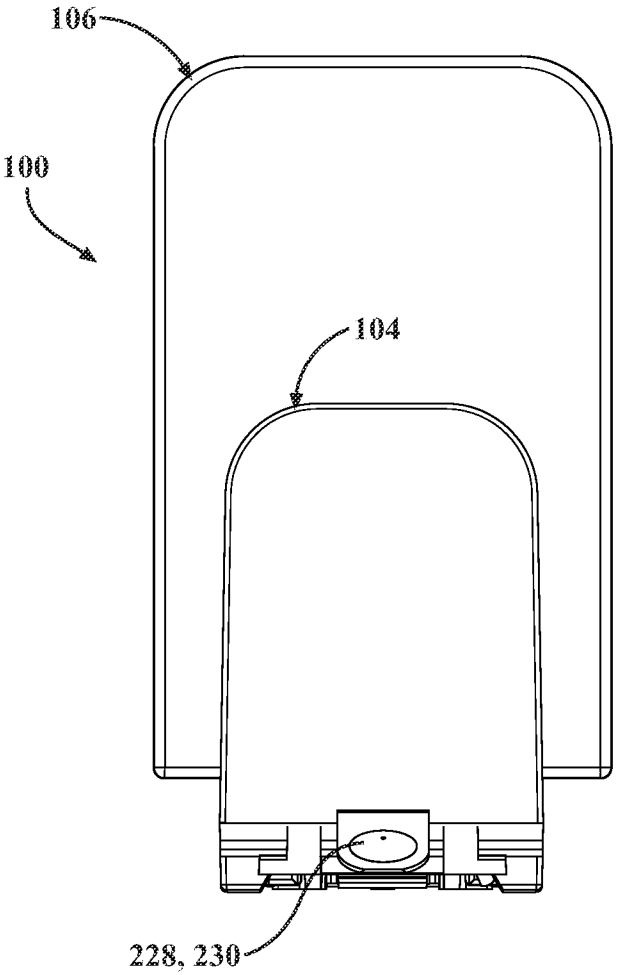
FIG. 7 is a front elevation view of the merchandising system of FIG. 1.
Figure 6:
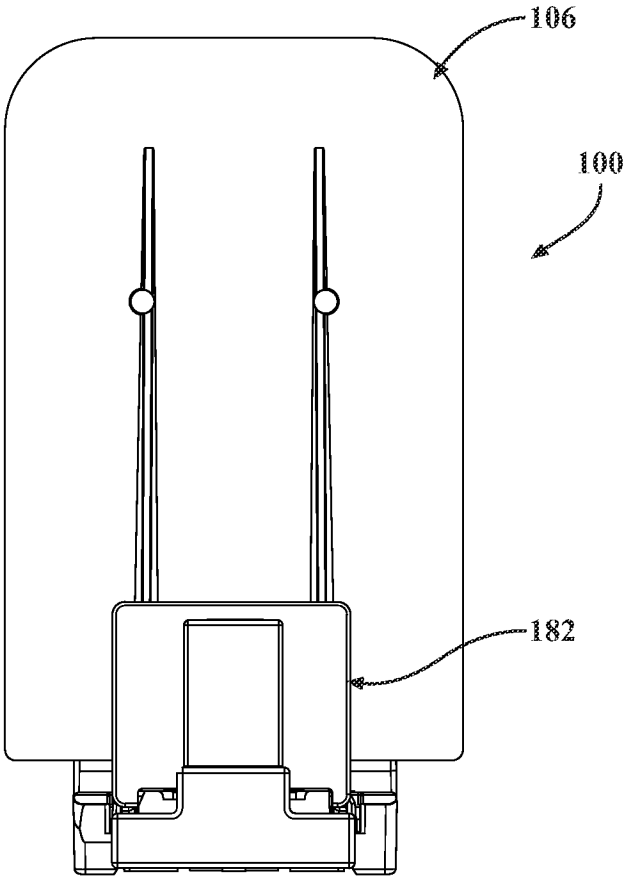
FIG. 6 is a rear elevation view of the merchandising system of FIG. 1.

Referring still to FIGS. 1 and 2, a length of the track 102 extends from a first end 112 to a second end 114. In use, the track 102 is typically installed on the shelf 12 such that the first end 112 of the track 102 faces towards the front edge 16 of the shelf 12 and the second end 114 of the track 102 faces towards the rear edge 18 of the shelf 12. The track may be further described as including a top wall or bedway 116 extending from the first end 112 to the second end 114. As discussed below, the bedway 116 forms a linear bearing path along which the primary pusher 106 and the puller system 110 operate. Accordingly, the bedway 116 may define one or more guide elements, such as grooves or rails, for maintaining tracking of the primary pusher 106 and the puller system 110.

Figure 10:
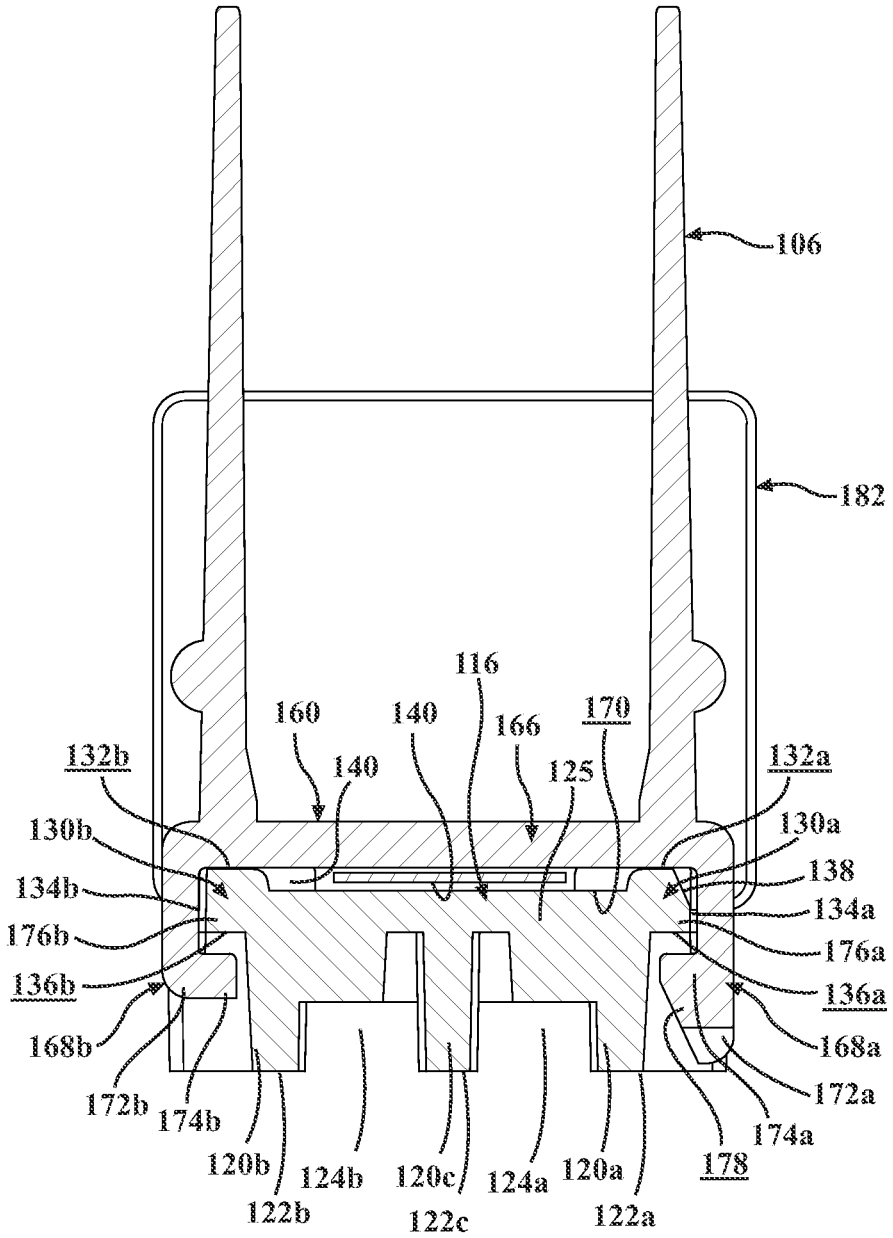
FIG. 10 is a cross sectional view of the merchandising system of FIG. 1, taken through a carriage of a primary pusher of the merchandising system.

Referring to FIGS. 1 and 2, the track 102 further includes a track base 118 upon which the bedway 116 is supported on the shelf 12. While the track base 118 may be formed with variety of suitable geometries, the track base 118 of the present disclosure is defined by the cooperation of a plurality of sidewalls 120*a*-120*c* (FIG. 10). Particularly, the track base 118 includes a first sidewall 120*a* extending along a first side of the track 102, a second sidewall 120*b* extending along an opposite side of the track 102, and an optional intermediate sidewall 120*c* disposed between the first sidewall 120*a* and second sidewall 120*b*. Each of the sidewalls 120*a*-120*c* extend from a bottom side of the bedway 116 to a respective distal end 122*a*-122*c*, which forms a portion of a bottom support surface of the track base 118.

Figure 8:
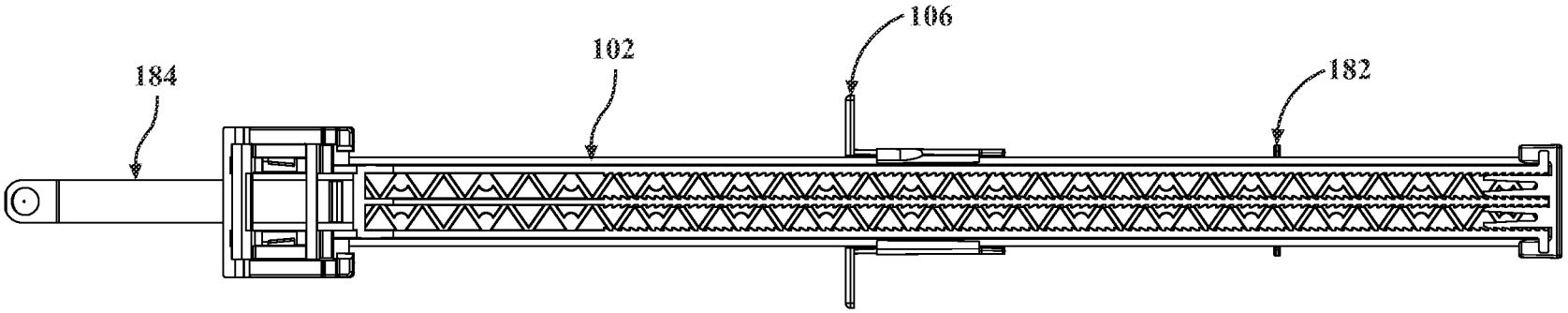
FIG. 8 is a bottom plan view of the merchandising system of FIG. 1.
Figure 9:
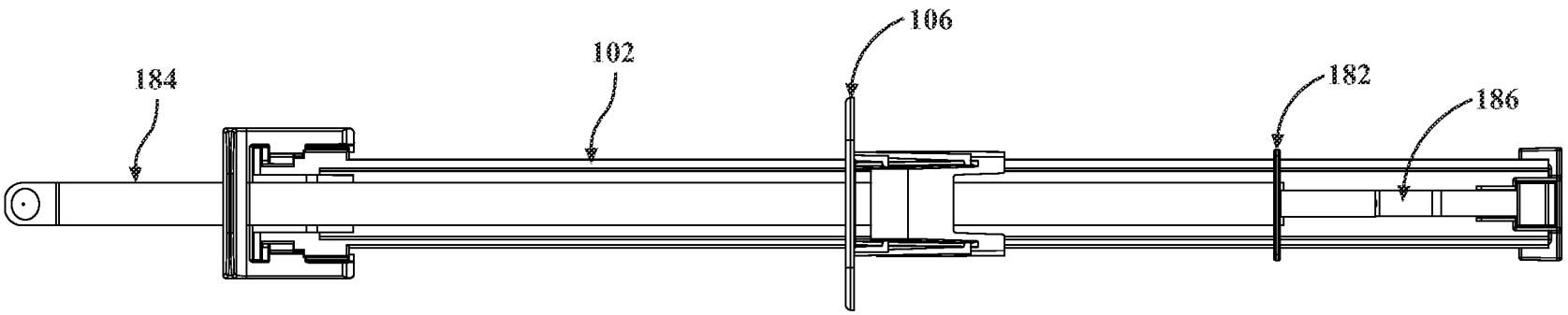
FIG. 9 is a top plan view of the merchandising system of FIG. 1.

With continued reference to FIG. 10, the sidewalls 120*a*-120*c* of the track base 118 define a pair of longitudinal channels 124*a*, 124*b* on the bottom side of the track 102, which extend continuously from the first end to the second end. Optionally, and as best shown in FIG. 8, the track base 118 may include a plurality of reinforcing members 125 connecting adjacent ones of the sidewalls 120*a*-120*c* within each of the channels 124*a*, 124*b*. Additionally, each of the sidewalls 120*a*-120*c* may define a plurality of retainers or teeth 126 arranged in series along the sidewalls 120*a*-120 within the channels 124*a*, 124*b*. The teeth 126 are generally configured to interface with the puller system 110 to secure the puller system 110 at the second end 114 of the track 102, as described in greater detail below.

With continued reference to FIGS. 1-4 and 10, the bedway 116 of the track 102 includes a pair of rails 130*a*, 130*b* along which the primary pusher 106 and the puller system 110 translate between the first end 112 and the second end 114. The rails 130*a*, 130*b* include a first rail 130*a* formed along the first side of the track 102 and a second rail 130*b* formed along the opposite second side of the track 102. Each of the rails 130*a*, 130*b* includes an upper rail surface 132 that defines a bearing surface along a top side of the track 102. Each rail 130*a*, 130*b* is further defined by an outer rail surface 134*a*, 134*b* that is offset outwardly from a respective one of the sidewalls 120*a*, 120*b*. For example the first rail 130*a* includes a first outer rail surface 134*a* that is offset outwardly from the first sidewall 120*a* of the track 102 and the second rail 130*b* includes a second outer rail surface 134*b* that is offset outwardly from the second sidewall 120*b* of the track 102.

Figure 14:
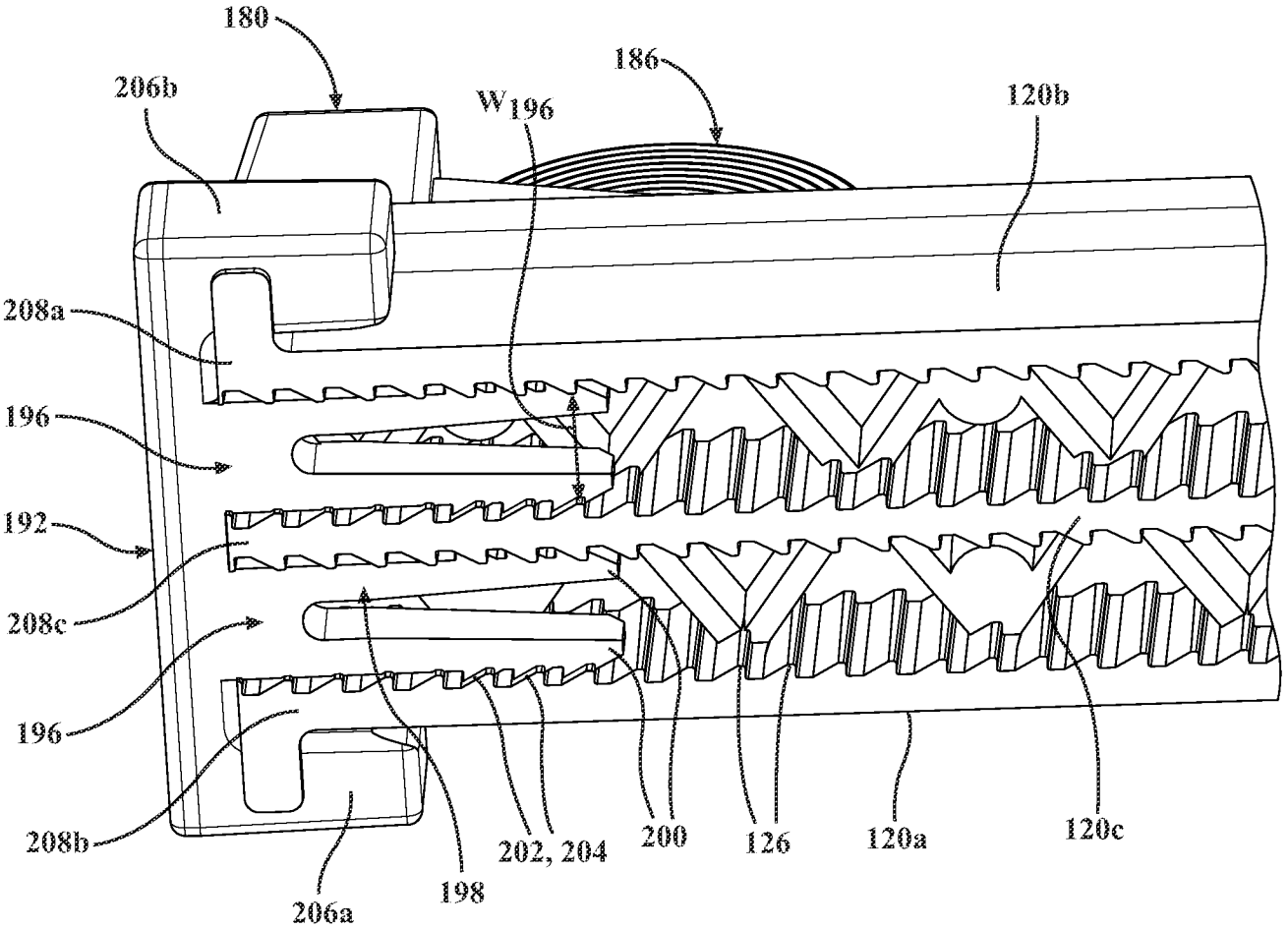
FIG. 14 is an enlarged fragmentary bottom perspective view of the merchandising system of FIG. 1.

The rails 130*a*, 130*b* may be configured with one or more features to facilitate engagement and retention of the primary pusher 106 and the puller system 110 on the track 102. For example, the aforementioned outward offset of each rail 130*a*, 130*b* results in a lower rail surface 136*a*, 136*b* of each rail 130*a*, 130*b* extending outwardly from a respective one of the sidewalls 120*a*, 120*b* of the track base 118. This lower rail surface 136*a*, 136*b* may serve as an undercut or catch for retaining the primary pusher 106 or other components on the bedway 116 when the merchandising system 100 is assembled. Optionally, at least one of the rails 130*a*, 130*b* may include a chamfer 138 between the upper rail surface 132*a*, 132*b* and the corresponding outer rail surface 134*a*, 134*b*, as best shown in FIG. 14. In use, this chamfer 138 provides a biasing surface along the top side of the track 102, which allows the primary pusher 106 and/or the puller system 110 to be snapped over and onto the track 102 from the top side.

With continued reference to FIG. 10, the bedway 116 may further define a channel 140 extending along the top side of the bedway 116 between opposing inner surfaces of the rails 130*a*, 130*b*. The channel 140 is configured with a depth for receiving an actuator 184 of the puller system 110 so that the actuator 184 can operate within the track 102 and beneath the primary pusher 106.

Figure 15:
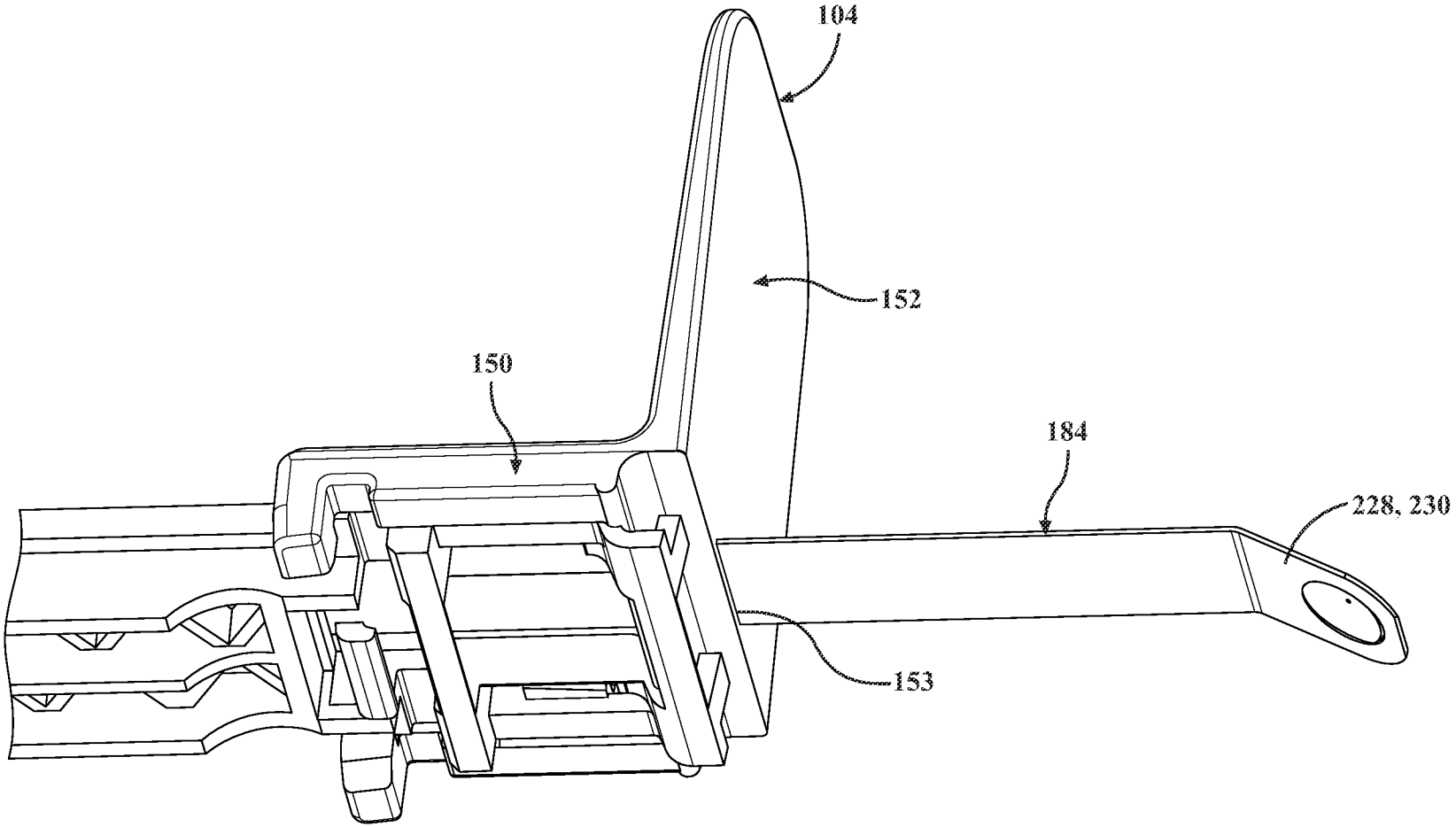
FIG. 15 is an enlarged fragmentary perspective view of the merchandising system of FIG. 1, shown an actuator in an extended position.
Figure 16:
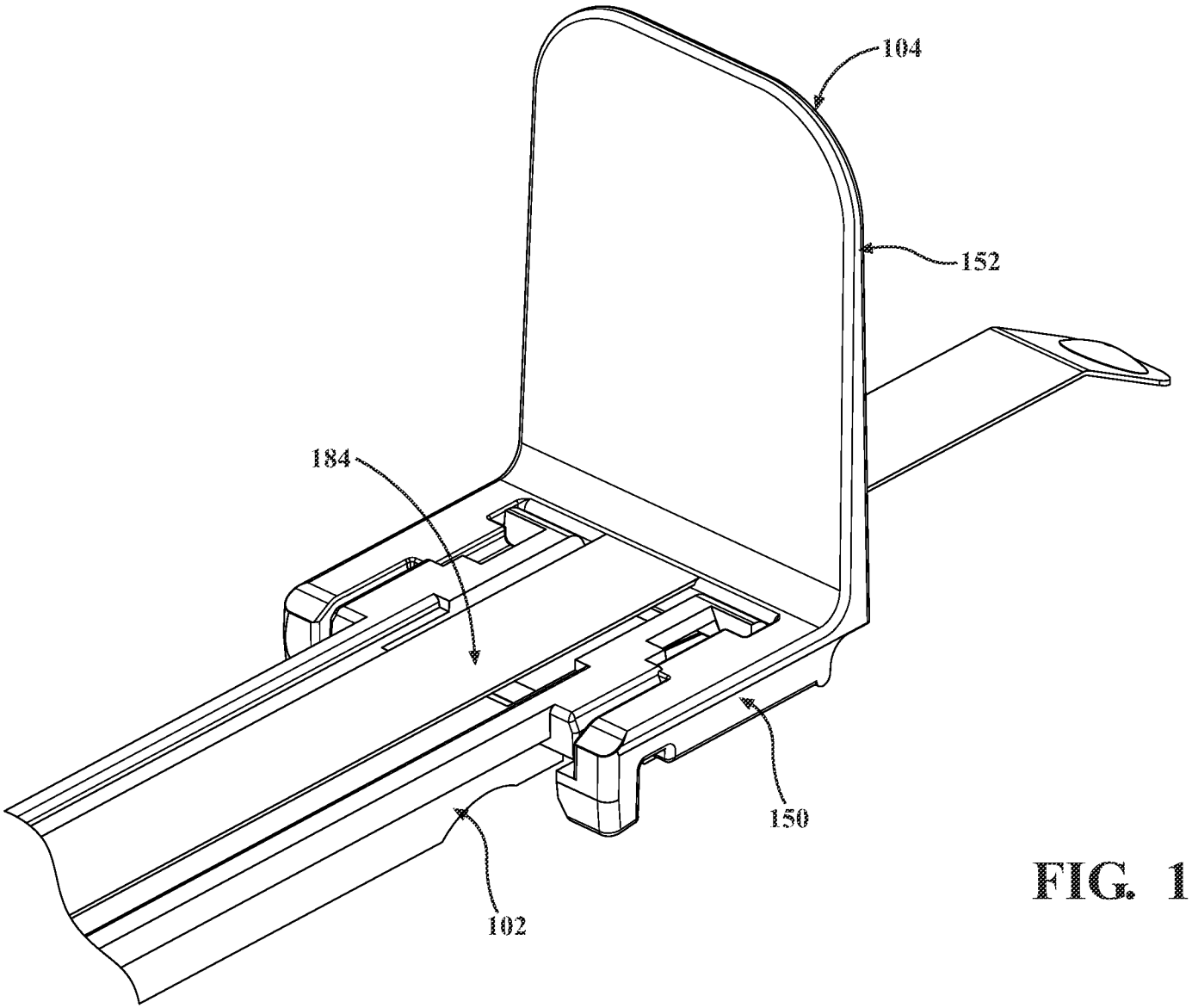
FIG. 16 is an enlarged fragmentary perspective view of the merchandising system of FIG. 1.

Referring to FIGS. 1-4, the front stopper 104 of the merchandising system 100 attaches to the first end 112 of the track 102. The front stopper 104 includes a stopper base 150 that selectively couples to the first end 112 of the track 102 and a stopper wall 152 that extends in a transverse direction from the stopper base 150 to provide a barrier at the first end 112 of the track 102. As best shown in FIG. 15, the stopper wall 152 may include a slot 153 configured to receive the actuator 184 of the puller system 110. Thus, the actuator 184 may extend through the stopper wall 152 such that a user can engage the actuator 184 from the first end 112 of the track 102.

With continued reference to FIGS. 1-4, the primary pusher 106 includes a carriage 160 slidably coupled to the bedway 116 of the track 102 and a primary pusher wall 162 attached to the carriage 160. In the illustrated example, the primary pusher wall 162 defines a substantially planar front pusher surface 164 extending in a transverse direction relative to the bedway 116 of the track. Here, the front pusher surface 164 faces the stopper wall 152 of the front stopper 104 to define a product receiving area A between the primary pusher wall 162 and the stopper wall 152. In use, the primary pusher 106 is configured to translate along the bedway 116 such that an effective length $L_A$ of the product receiving area A increases and decreases to accommodate the products that are received within the product receiving area A. In other words, the primary pusher 106 may be translated in a first direction D1 away from the front stopper 104 to increase the effective length $L_A$ of the product receiving area A when products are loaded into the merchandising system 100, and may be translated in a second direction D2 towards the front stopper 104 to decrease the effective length $L_A$ of the product receiving area A as products are removed from the merchandising system 100. Thus, the primary pusher 106 is operable to maintain stocked products at a forward-most position against the front stopper 104.

Figure 11:
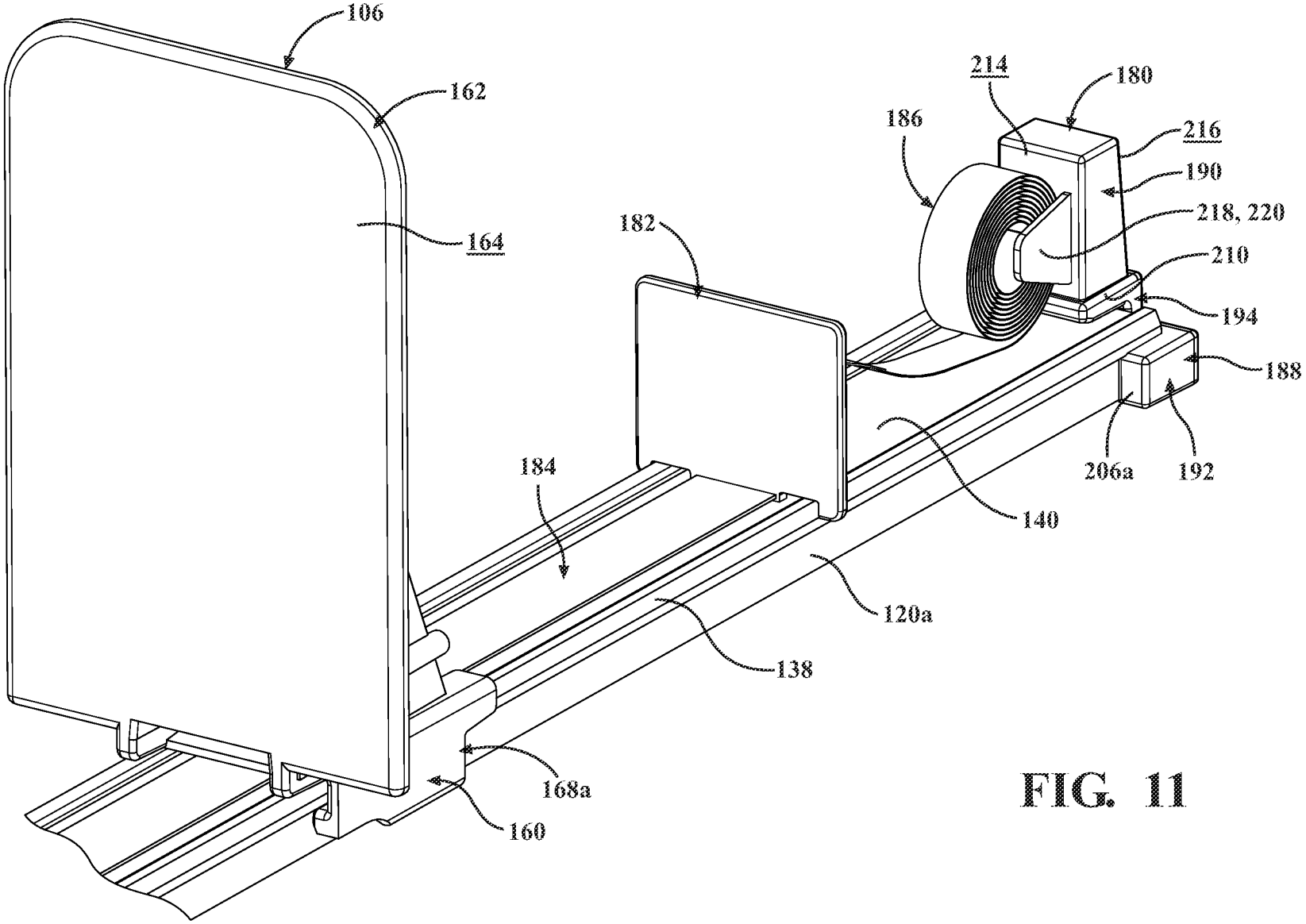
FIG. 11 is an enlarged fragmentary front perspective view of the merchandising system of FIG. 1.
Figure 12:
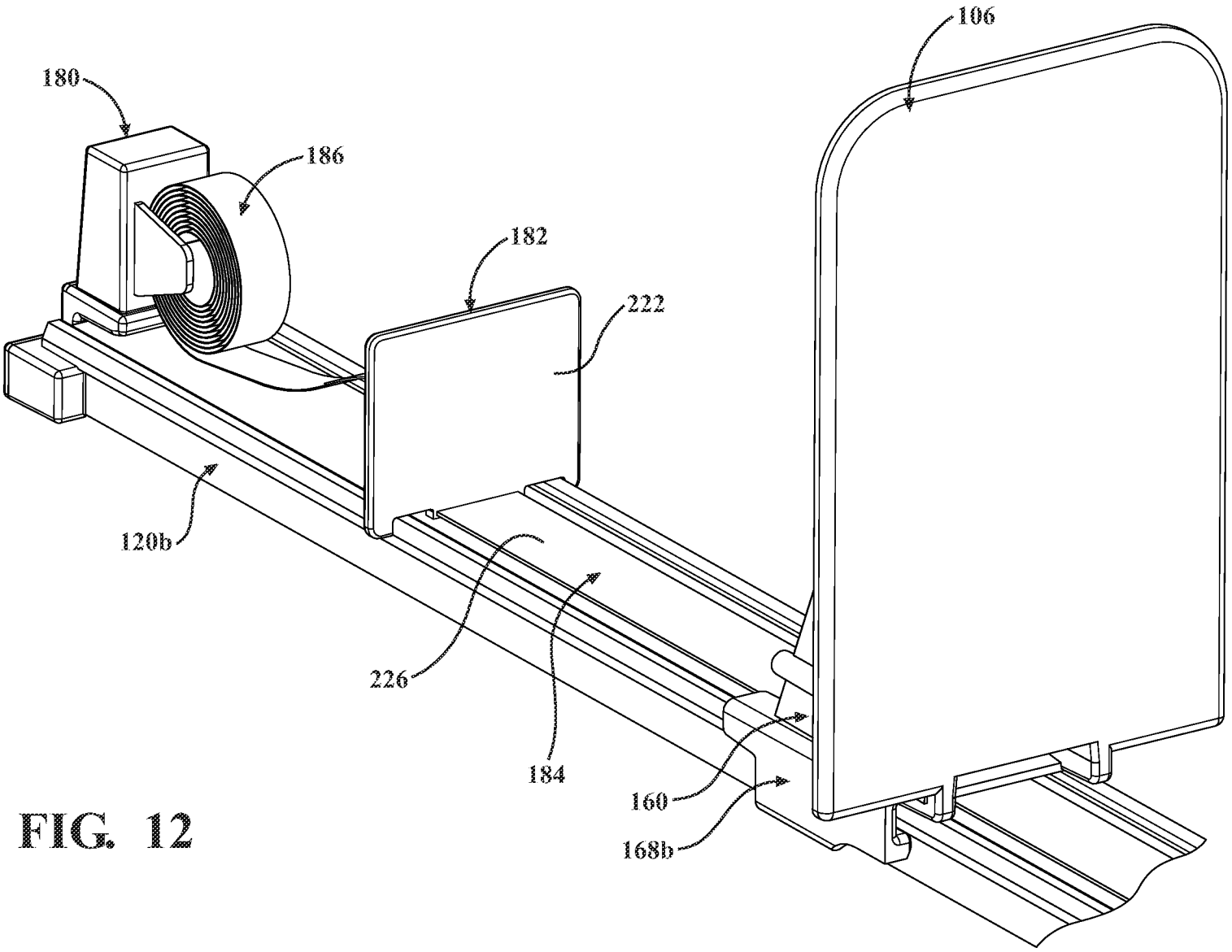
FIG. 12 is an enlarged fragmentary front perspective view of the merchandising system of FIG. 1.

Referring to FIGS. 10-12, the carriage 160 includes a carriage base 166 disposed on the top side of the bedway 116 and a pair of side bearings 168*a*, 168*b* each configured to slidingly engage a respective one of the rails 130*a*, 130*b* of the bedway 116. As best shown in FIG. 10, the carriage base 166 includes a lower bearing surface 170 configured to slidingly interface with the upper rail surfaces 132 of the rails 130*a*, 130*b*. The side bearings 168*a*, 168*b* extend from opposite sides of the carriage base 166 to respective distal ends 172, which include retainers 174*a*, 174*b* configured to interface with the lower rail surface 136 to retain the carriage 160 on the bedway 116 when the merchandising system 100 is assembled. In other words, the retainers 174*a*, 174*b* protrude inwardly towards the sidewalls 120*a*, 120*b* of the track 102 and define a pair of grooves 176*a*, 176*b* each configured to receive one of the rails 130*a*, 130*b* therein.

As shown, the first side bearing 168*a* includes a first retainer 174*a* that defines a chamfered or biased inner surface 178 configured to interface with the chamfer 138 of the first rail 130*a* during assembly of the merchandising system 100. In the illustrated example, the second retainer 174*b* of the second side bearing 168*b* is formed as a substantially perpendicular elbow at the distal end 172*b* of the second side bearing 168*b*. However, the second retainer may also be formed with a chamfered inner surface, similar to that of the first retainer 174*a*. In use, the carriage 160 is assembled to the track 102 by initially positioning the second retainer 174*b* beneath the lower rail surface 136*b* of the second rail 130*b* so that the second rail 130*b* is received within the second groove 176*b* defined by the second side bearing 168*b*. With the second side bearing 168*b* engaged with the second rail 130*b*, the first side bearing 168*b* is lowered towards the first rail 130*a* so that the chamfered inner surface 178 of the first retainer 174*a* engages the chamfer 138 of the first rail 130*a*. A downward engagement force may be applied to the carriage 160, causing the chamfer 138 of the first rail 130*a* to bias the first side bearing 168*a* outwardly as the first retainer 174*a* moves past the first rail 130*a*. Once the first retainer 174*a* clears the lower rail surface 136*a* of the first rail 130*a*, the first retainer 174*a* will snap into the space beneath the lower rail surface 136*a* to capture the first rail 130*a* within the first groove 176*a*, thereby slidably securing the carriage 160 to the bedway 116 of the track 102.

In the illustrated example, the primary pusher 106 is configured as a passive pusher configured to be manually translated along the track 102 in the first direction D1 and the second direction D2. Thus, the primary pusher 106 does not include a drive (e.g., motor) or biasing (e.g., spring) mechanism for translating the primary pusher 106 along the track 102. However, in other examples, the primary pusher 106 may be configured as an active pusher, wherein the primary pusher 106 includes an integrated biasing system configured to bias the primary pusher 106 in the second direction D2 towards the front stopper 104.

Referring now to FIGS. 1-4 and 11-13, the puller system 110 is configured to provide a means for selectively biasing the primary pusher 106 in the second direction D2 to reduce the effective length $L_A$ of the product receiving area A. For example, when the product receiving area A is partially filled with products, the puller system 110 may be actuated by a user (e.g., a store associate) to move the primary pusher 106 in the second direction to consolidate the products against the front stopper 104.

As shown in FIG. 11, the puller system 110 includes a rear stanchion 180 disposed at the second end 114 of the track 102, a secondary pusher 182 wall slidably coupled to the track 102 between the primary pusher 106 and the stanchion 180, an actuator 184 configured to bias the secondary pusher 182 in the second direction D2, and a retraction member 186 configured to bias the secondary pusher 182 in the first direction D2. In use, a user may apply a first force F1 to the actuator 184 to move the secondary pusher 182 in the second direction, whereby the secondary pusher 182 contacts the primary pusher 106 to bias the primary pusher 106 in the second direction D2. When the first force is released, a second force F2 applied by the retraction member 186 moves the secondary pusher 182 in the first direction D1 to retract the actuator 184 into the first end 112 of the track.

Referring still to FIG. 11, the stanchion 180 is disposed at the second end 114 of the track 102. The stanchion 180 includes a stanchion base 188 that attaches to the second end 112 of the track 102 and a stanchion post 190 extending upwardly from the stanchion base 188. As discussed below, the stanchion 180 is generally configured to support a first end of the retraction member 186 at the second end 114 of the track, whereby the stanchion 180 provides an anchoring point for the retraction member 186.

Figure 13:
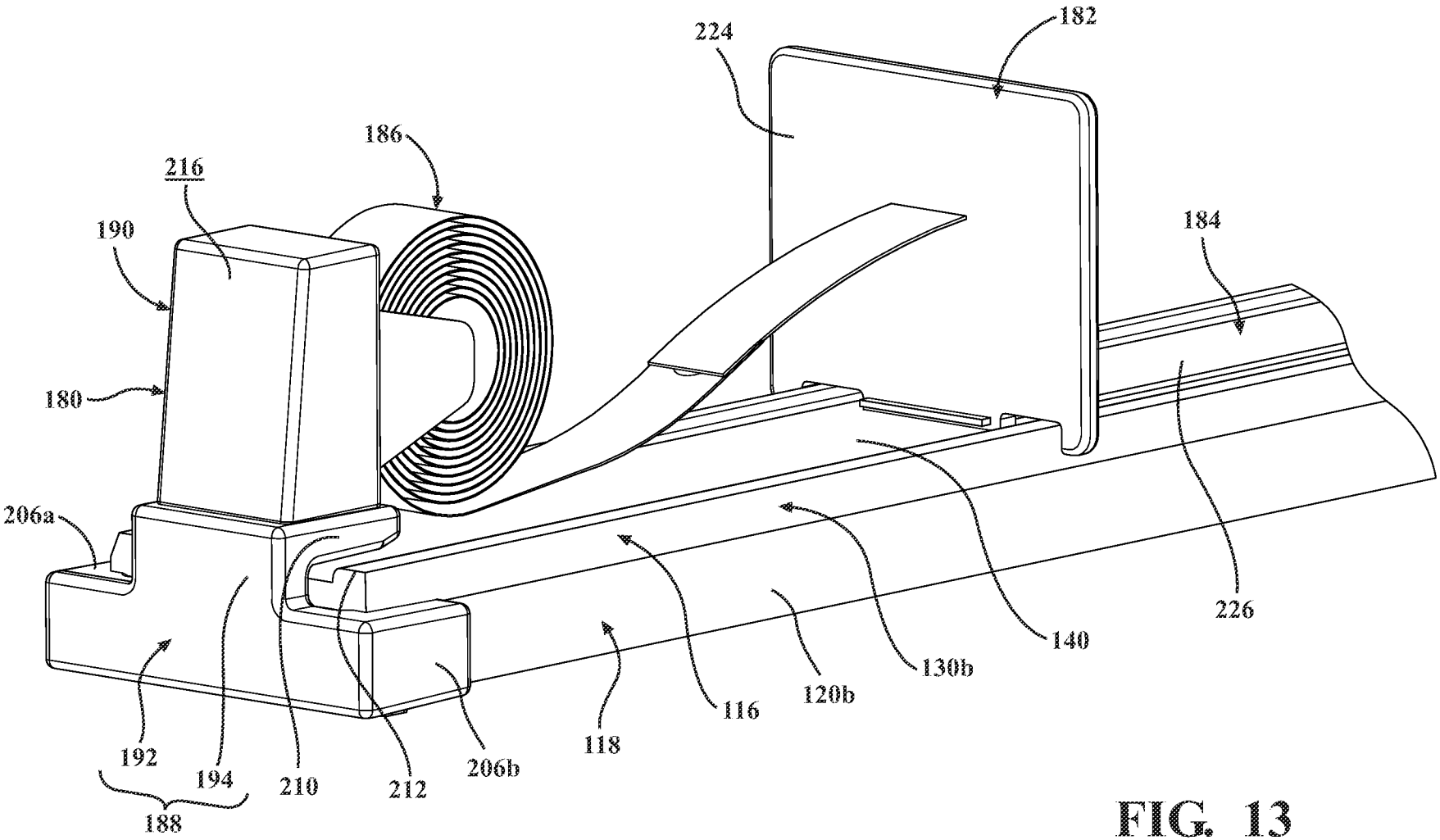
FIG. 13 is an enlarged fragmentary rear perspective view of the merchandising system of FIG. 1.

Referring to FIGS. 13 and 14, the stanchion base 188 is configured to attach to the second end 114 of the track 102. The stanchion base 188 includes coupler 192 that engages with the track base 118 and a neck portion 194 that extends from the coupler 192 and over the bedway 116 of the track. As best shown in FIG. 14, the coupler 192 is generally configured to mate with the track base 118 to secure the stanchion 180 to the track 102.

The coupler 192 includes a pair of clips 196 each configured to be received within a respective one of the lower channels 124*a*, 124*b* of the track base 118. Here, each clip 196 includes an opposing pair of prongs 198 that extend from a rear wall of the coupler 192 to a respective distal end 200. Each prong 198 may be described as a longitudinal axis extending along a length of the clip 196 from the rear wall to the distal end 200. As shown, the longitudinal axes of respective pairs of the prongs 198 diverge from each other along the second direction D2. In other words, each pair of prongs 198 is formed as a fork, whereby the distal ends 200 of the prongs 198 of each clip 196 are spaced farther apart from each other than proximal ends (i.e., ends attached at to the rear wall) of the prongs 198. The prongs 198 may be formed of a resilient material, whereby the distal ends 200 prongs 198 of each clip 196 are naturally formed with an overall width $W_{196}$ that is greater than a width of one of the channels 124*a*, 124*b* and can be biased or flexed inwardly for insertion within the channels 124*a*, 124*b*. As discussed below, the resilience of the prongs 198 causes the prongs 198 to bias against outwardly against the interior surfaces of the sidewalls 120*a*-120*c* to secure the clips 196 within the channels 124*a*, 124*b*.

Each prong 198 may be described as including an inner surface that faces the other one of the prongs 198 of the clip 196 and an outer surface 202 that faces away from the other one of the prongs 198 of each clip 196. As shown in FIG. 14, the outer surface 202 of each prong 198 is configured to interface with a respective one of the sidewalls 120*a*-120*c* to secure the coupler 192 within the track base 118. Particularly, the outer surface 202 may include a plurality of biased teeth 204 configured to engage with the teeth 126 formed on a respective one of the sidewalls 120*a*-120*c*. Particularly, the teeth 204 may be formed as ratcheting teeth, whereby the teeth 204 include a biased leading surface configured to pass over the teeth 126 as the coupler 192 is inserted into the track base 118 in the second direction D2. The teeth 204 further include an undercut or orthogonal trailing surface configured to engage with an opposing front surface of corresponding ones of the track teeth 126 to prevent removal of the coupler 192 from the track base 118 in the first direction D1.

In addition to the clips 196, the coupler 192 may further include a pair of outer arms 206*a*, 206*b* each extending from the rear wall of the coupler 192 along opposite sides of the track base 118. For example, a first arm 206*a* extends along an outer surface of the first sidewall 120*a* and a second arm 206*b* extends along an outer surface of the second sidewall 120*b*. Generally, the arms 206*a*, 206*b* provide additional stability between the coupler 192 and the track base 118. The arms 206*a*, 206*b* and the prongs 198 may be spaced along a width of the coupler 192 to define a plurality of sockets 208 for receiving end portions of each of the sidewalls 120*a*-120*c*. For example, the first arm 206*a* is spaced apart from a first one of the clips 196 by a first socket 208*a* that receives an end of the first sidewall 120*a*, the second arm 206*b* is spaced apart from the other one of the clips 196 by a second socket 208*b* that receives an end of the second sidewall 120*b*, and the clips 196 are spaced apart from each other by a third socket 208*c* that receives an end of the intermediate sidewall 120*c*. Thus, the interfaces between the sidewalls 120*a*-120*c* and the respective sockets 208*a*-208*c* provide increased stability between the stanchion 180 and the track 102.

Referring to FIG. 13, the neck portion 194 of the stanchion base 188 extends upwardly from the coupler 192. In this example, the neck portion 194 also extends in the second direction over a portion of the bedway 116 to define a platform 210 for the stanchion post 190. Here, the platform 210 is spaced apart from a top side of the coupler 192 by a receptacle 212 configured to receive the bedway 116 therein, between the platform 210 and the coupler 192. This receptacle 212 provides vertical stability to the stanchion 180 by increasing the interface between the stanchion 180 and the track 102.

The stanchion post 190 extends upwardly from the platform 210 and includes a front surface 214 facing the second direction D2 (i.e., towards the first end 112) and a rear surface 216 facing in the first direction D1 (i.e., away from the first end 112). In the illustrated example, the stanchion post 190 includes a trunnion 218 disposed on the front surface 214. Here the trunnion 218 includes an opposing pair of trunnion tabs 220 that cooperate to support a first portion of the retraction member 186. While the trunnion 218 is shown as being disposed on the front surface 214, the trunnion 218 could optionally be disposed on the rear surface 216.

With reference to FIGS. 12 and 13, the secondary pusher 182 is slidably disposed on the track 102 between the primary pusher 106 and the stanchion 180. The secondary pusher 182 includes a front side 222 facing in the second direction D2 and a rear side 224 facing in the opposite direction. A bottom side of the secondary pusher 182 includes a complementary profile to the bedway 116, whereby a central portion of the secondary pusher 182 that is attached to the actuator 184 and is configured to nest within the channel 140 of the bedway. The secondary pusher 182 further includes pair of notches receive the rails 130*a*, 130*b*. In other examples, the secondary pusher 182 may include a carriage configured in a similar manner as the carriage 160. Alternatively, the secondary pusher 182 may be provided with just a central portion attached to the actuator 184, whereby the secondary pusher 182 does not interface with the rails 130*a*, 130*b*.

Referring still to FIGS. 1-4, the actuator 184 of the puller system 110 is configured to provide a user with a means for operating the secondary pusher 182 from the front edge 16 of the shelf 12. As shown, the actuator 184 includes an elongate strip extending from a first end 226 attached to the secondary pusher 182 to a second end 228 extending from the first end 112 of the track 102. The actuator 184 is configured to be received within the channel 140 formed on the top side of the bedway 116, whereby a top surface of the actuator 184 is offset below the upper rail surfaces 132 of the rails 130*a*, 130*b*. Thus, the actuator 184 is routed along the channel 140 and beneath the primary pusher 106 such that the actuator 184 can move in the first direction D1 and the second direction D2 within the channel 140, independent of the primary pusher 106. Optionally, the actuator 184 may extend beneath the front stopper 104 or through an opening or slot 153 formed through the front stopper 104. The actuator 184 may include a handle or grip 230 formed at the second end 228.

With continued reference to FIGS. 1-4, the retraction member 186 includes a first portion coupled to the stanchion 180 and a second portion coupled to the secondary pusher 182, and is configured to provide a continuous biasing force to the secondary pusher 182 in the first direction D1. In the illustrated example, the retraction member 186 includes a constant force spring having a coil portion mounted in the trunnion 218 of the stanchion 180 and a free end attached to the rear side 224 of the secondary pusher 182. Thus, the retraction member 186 is configured to provide a constant biasing force to the secondary pusher 182 in the first direction. While the illustrated example shows the retraction member 186 as a constant-force spring having the coil portion mounted on the stanchion 180, the design may be inverted such that the coil portion is attached at the secondary pusher 182. Optionally, other types of biasing elements may also be utilized to apply the biasing force to the secondary pusher 182.

In use, the retraction member 186 naturally biases the secondary pusher 182 to a retracted position at the second end 114 of the track, as shown in FIGS. 1-4. The primary pusher 106 is adjusted to a first position to define an effective length $L_A$ of the product receiving area A sufficient to hold a first inventory of products. As products are removed from the first inventory, a population density of the products is reduced and spaces or gaps may form between the products within the product receiving area A, or worse, the products may be spaced away from the front edge 16 of the shelf such that it appears that the products are out of stock. To consolidate the remaining inventory within the product receiving area A, a user applies an actuating force F1 to the grip 230 of the actuator in the second direction D2. When the actuating force F1 overcomes the spring force F2 applied by the retraction member 186, the secondary pusher 182 moves in the second direction D2 until it contacts the primary pusher 106. The user continues applying a sufficient first force F1 to overcome any resistive forces imparted by the primary pusher 106 and the products, thereby causing the primary pusher 106 to consolidate the products at the front edge 16 of the shelf 12.

Once the products are sufficiently consolidated at the front edge 16 of the shelf 12, the user may decrease or release the first force F1 on the grip 230 of the actuator until the second force F2 applied by the retraction member 186 overcomes the first force F1. The retraction member 186 causes the secondary pusher 182 to move in the first direction D1 along the track 102 to return to the retracted position. Consequently, the second end 228 of the actuator 184 and the grip 230 are retracted back into the channel 140 of the track for subsequent use. The actuator 184 may be used repeatedly used by a user to ensure that product inventory remains consolidated at the forward-most portion of the merchandising system 100.

With particular reference to FIGS. 17-21, an example of a merchandising system 100*a* is provided and includes a primary pusher 106*a* and a pusher system 110*a* attached to the track 102. As shown, the track 102 is provided without the front stopper 104. However, the front stopper 104 would be attached at the first end 112 of the track 102, as previously described. In view of the substantial similarity in structure and function of the components associated with the merchandising system 100 with respect to the merchandising system 10*a*, like reference numerals are used hereinafter and in the drawings to identify like components while like reference numerals containing letter extensions are used to identify those components that have been modified.

Figure 17:
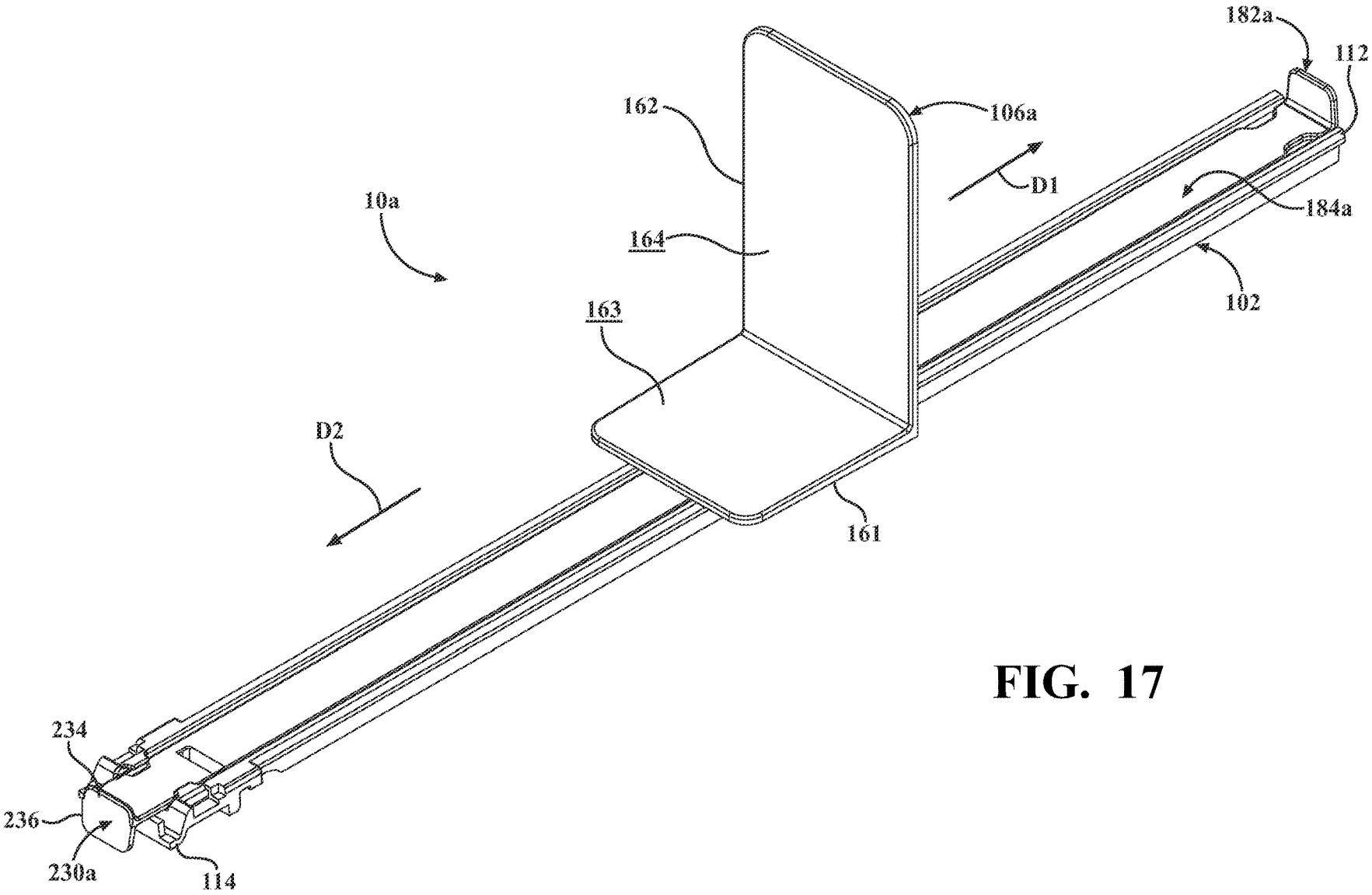
FIG. 17 is a front perspective view of another configuration of a merchandising system according to the principles of the present disclosure.

In the example of FIGS. 17-20, the merchandising system 100*a* is provided as a passive system, whereby the pusher system 110*a* is manually actuated in the first direction D1 and the second direction D2. Thus, as shown FIGS. 17-20, the pusher system 110*a* does not include a retractor or any biasing elements for returning the pusher system 110*a* from an actuated state (FIG. 18) to a retracted state (FIG. 17).

Figure 18:
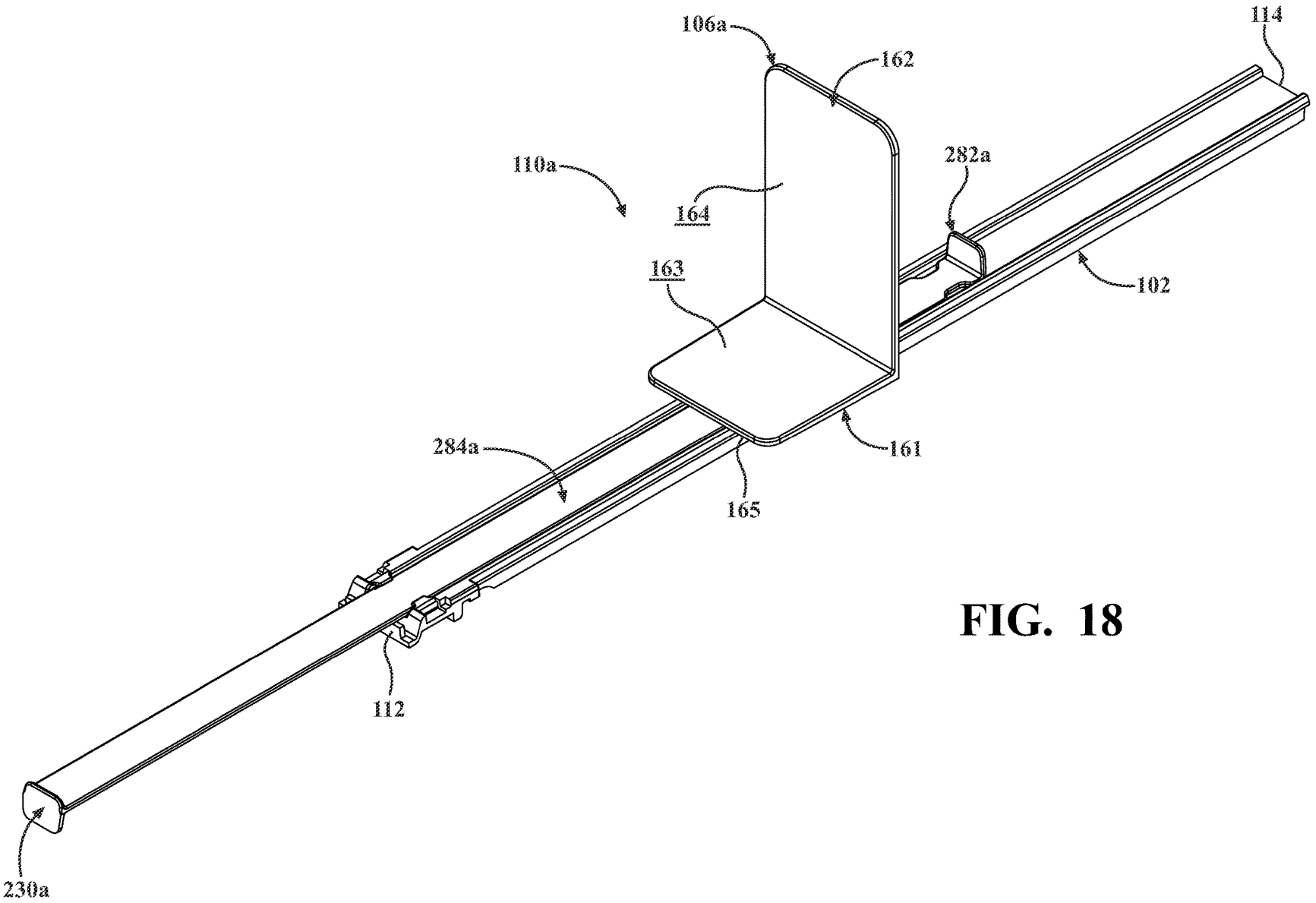
FIG. 18 is a front perspective view of the merchandising system of FIG. 17, showing an actuator in an extended configuration.
Figure 19:
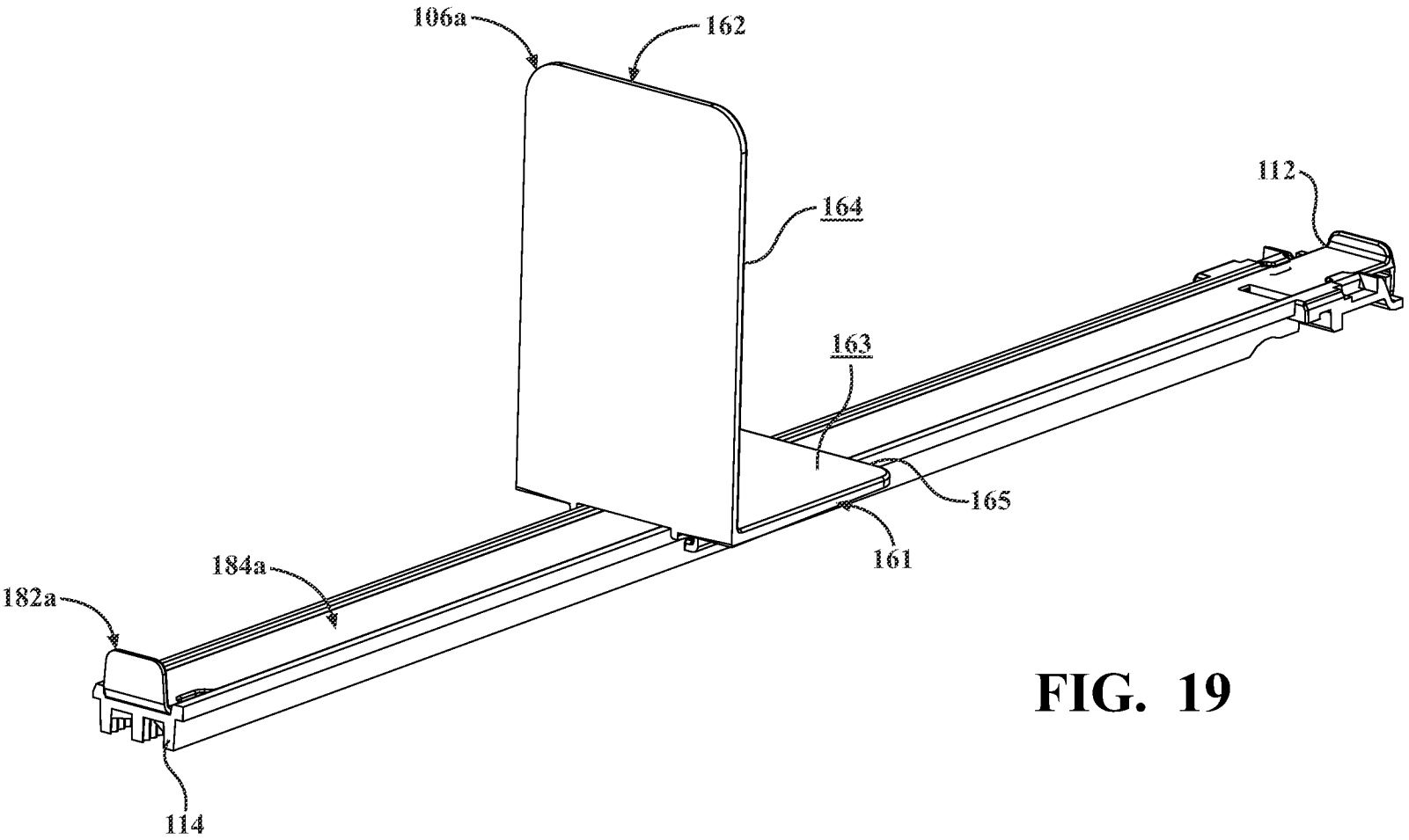
FIG. 19 is a front perspective view of the merchandising system of FIG. 17, showing an actuator in a retracted configuration.
Figure 20:
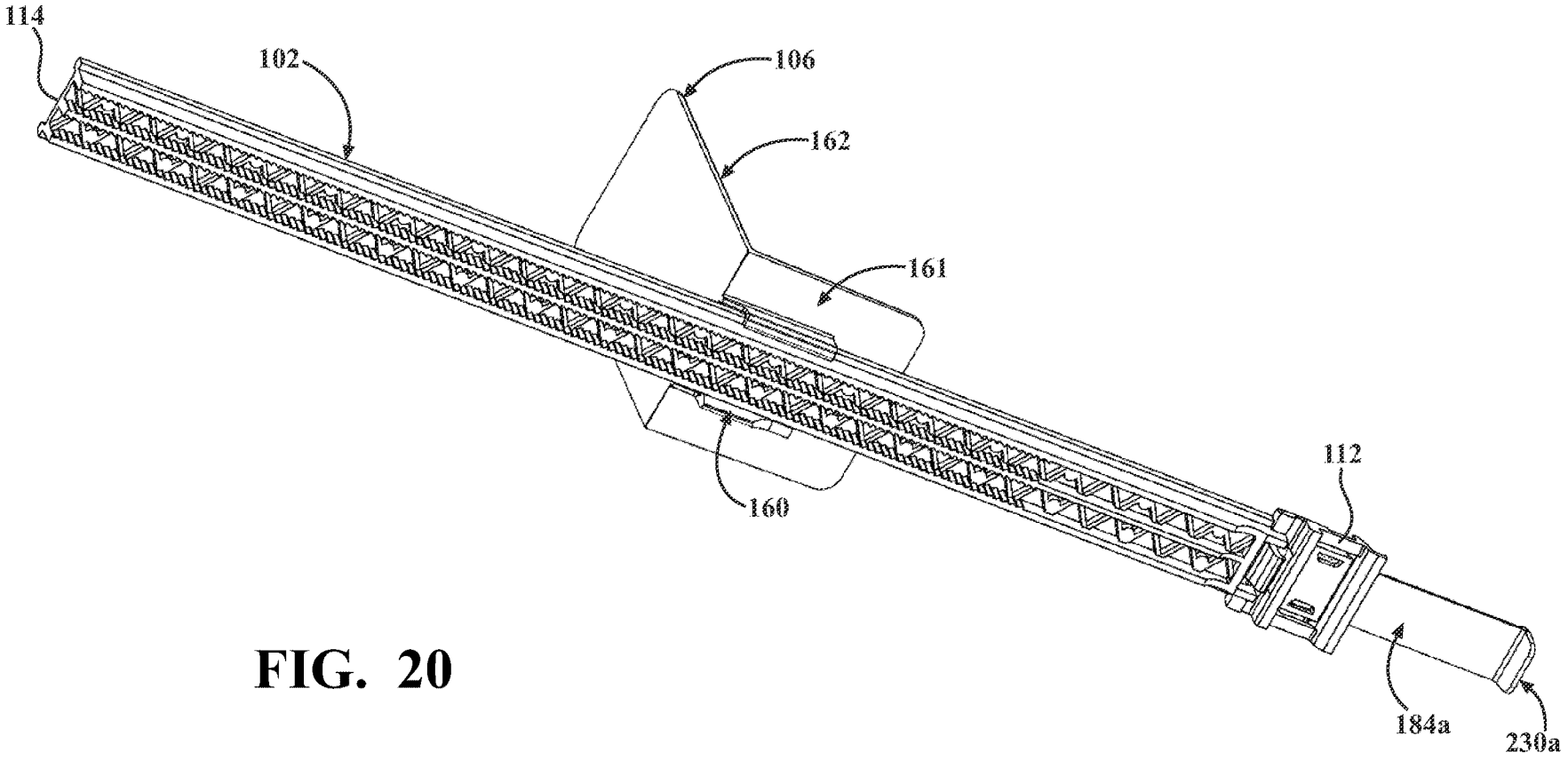
FIG. 20 is a bottom perspective view of the merchandising system of FIG. 17, showing an actuator in a retracted configuration.

Referring to FIGS. 17-19, the pusher system 110*a* includes a primary pusher 106*a* operable to translate along the track 102. As shown in FIG. 20, the primary pusher 106*a* includes the carriage 160 for slidably coupling the primary pusher 106*a* to the bedway 116 of the track 102. The primary pusher 106*a* of the present example includes a pusher platform 161 disposed on or formed integrally with the carriage base 166. The primary pusher 106*a* further includes the primary pusher wall 162 extending from the pusher platform 161 and including the front pusher surface 164. As shown, the primary pusher wall 162 is oriented transverse to the pusher platform 161 and the bedway 116 of the track 102. In the illustrated example, the front pusher surface 164 is generally planar and is oriented orthogonal to the bedway 116. However, other shapes of front pusher surfaces 164 may be included to accommodate corresponding product geometries (e.g., concave pusher surface for cylindrical products).

Figure 21:
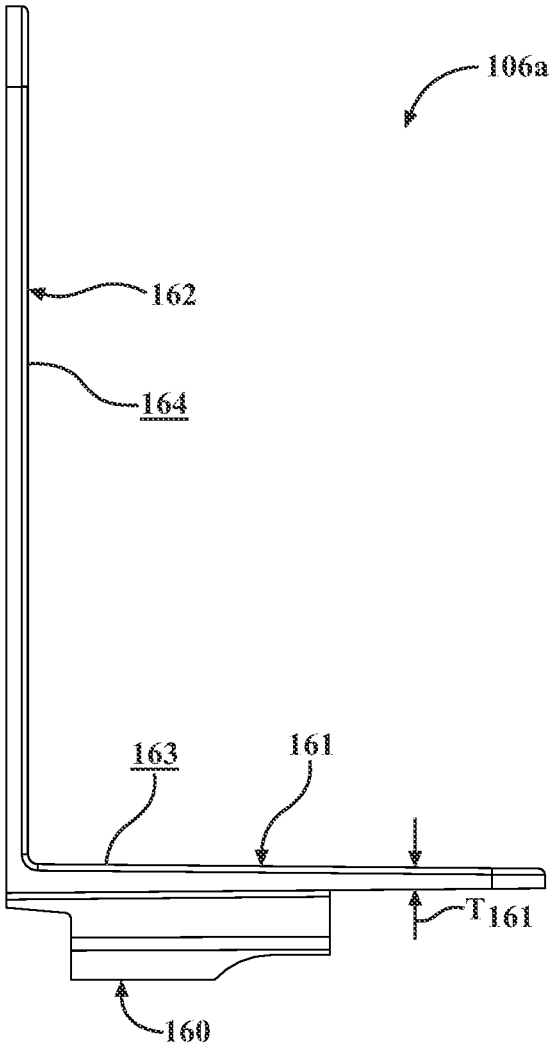
FIG. 21 is a side elevation view of a primary pusher of a merchandising system according to the principles of the present disclosure.

Referring to FIG. 21, the primary pusher 106*a* of the present example may be described has having an inverted configuration compared to the primary pusher 106 shown in the example of FIGS. 1-16. For example, in FIGS. 1-16 the primary pusher 106 is configured such that the front pusher surface 164 is positioned in front of the carriage 160 relative to the ends 112, 114 of the track 102. In other words, the carriage 160 is positioned between the primary pusher wall 162 and the second end 112 of the track 102 in the merchandising system 100 previously described. In the present example, the carriage 160 is positioned forward of the primary pusher wall 162 relative to the ends 112, 114 of the track 102. Thus, the carriage 160 and the pusher platform 161 are disposed within the product receiving area A, whereby the pusher platform 161 is operable to support at least a portion of the product inventory disposed within the product receiving area A.

Referring still to FIG. 21, the pusher platform 161 includes an upper platform surface 163 disposed on an opposite side from the carriage 160. The pusher platform 161 and the upper platform surface 163 may be described as extending along the second direction D2 from the front pusher surface 164 of the primary pusher wall 162 to a front distal end 165. As shown in FIG. 21, a thickness $T_{161}$ of the pusher platform 161 may taper along the direction from the front pusher surface 164 to the front distal end 165. In other words, the upper platform surface 163 is oriented at an oblique angle relative to the carriage 160 and the front pusher surface 164 such that the upper platform surface 163 extends at a decline from the front pusher surface 164 to the front distal end 165. The tapered thickness $T_{161}$ provides a knifing function that allows the front distal end 165 to slide beneath rear-most product inventory in the product receiving area A when the primary pusher 160*a* is biased in the second direction D2 towards the first end 112.

Referring still to FIGS. 17-20, the pusher system 110*a* includes a secondary pusher 182*a* disposed between the primary pusher 106*a* and the second end 114 of the track 102. The secondary pusher 182*a* is slidably received within the channel 140 of the track 102 and generally includes a planar tab or wall configured to engage the primary pusher 106*a* to bias the primary pusher in the second direction D2. The secondary pusher 182*a* is connected to an actuator 184*a* substantially similar in form to the actuator 184 described previously. Thus, the secondary pusher 182 includes a front side 222 facing in the second direction D2 and a rear side 224 facing in the opposite direction. As shown, the actuator 184*a* includes an elongate strip extending from the first end 226 attached to the secondary pusher 182*a* to the second end 228 extending from the first end 112 of the track 102. In this example, the second end 228 includes a grip 230*a* including upper and lower flanges 234, 236 extending in opposite directions (e.g., up and down) from the second end 228 to provide an opposing pair of gripping features.

In use, the retraction member 186 naturally biases the secondary pusher 182 to a retracted position at the second end 114 of the track, as shown in FIGS. 1-4. The primary pusher 106 is adjusted to a first position to define an effective length $L_A$ of the product receiving area A sufficient to hold a first inventory of products. As products are removed from the first inventory, a population density of the products is reduced and spaces or gaps may form between the products within the product receiving area A, or worse, the products may be spaced away from the front edge 16 of the shelf such that it appears that the products are out of stock. To consolidate the remaining inventory within the product receiving area A, a user applies an actuating force F1 to the grip 230 of the actuator in the second direction D2. When the actuating force F1 overcomes the spring force F2 applied by the retraction member 186, the secondary pusher 182 moves in the second direction D2 until it contacts the primary pusher 106. The user continues applying a sufficient first force F1 to overcome any resistive forces imparted by the primary pusher 106 and the products, thereby causing the primary pusher 106 to consolidate the products at the front edge 16 of the shelf 12.

Once the products are sufficiently consolidated at the front edge 16 of the shelf 12, the user may decrease or release the first force F1 on the grip 230 of the actuator until the second force F2 applied by the retraction member 186 overcomes the first force F1. The retraction member 186 causes the secondary pusher 182 to move in the first direction D1 along the track 102 to return to the retracted position. Consequently, the second end 228 of the actuator 184 and the grip 230 are retracted back into the channel 140 of the track for subsequent use. The actuator 184 may be used repeatedly used by a user to ensure that product inventory remains consolidated at the forward-most portion of the merchandising system 100.

In use, primary pusher 106*a* is adjusted to a first position to define an effective length $L_A$ of the product receiving area A sufficient to hold a first inventory of products. As products are removed from the first inventory, a population density of the products is reduced and spaces or gaps may form between the products within the product receiving area A, or worse, the products may be spaced away from the front edge 16 of the shelf such that it appears that the products are out of stock. To consolidate the remaining inventory within the product receiving area A, a user applies an actuating force F1 to the grip 230*a* of the actuator 284*a* in the second direction D2. The actuating force F1 causes the secondary pusher 182*a* to move in the second direction D2 until it contacts the primary pusher 106*a*. The user continues applying a sufficient first force F1 to overcome any resistive forces imparted by the primary pusher 106*a* and the products, thereby causing the primary pusher 106*a* to consolidate the products at the front edge 16 of the shelf 12. Here, the pusher platform 161 may be biased beneath at least a portion of the product inventory, such that the weight of the product inventory is supported on the upper platform surface 163.

Once the products are sufficiently consolidated at the front edge 16 of the shelf 12, the user may apply a second force F2 to the grip 230*a* to bias the actuator 184*a* and the secondary pusher 182*a* in the first direction D1 towards the second end 114 of the track. The weight of the product inventory creates an increased frictional force between the primary pusher 106*a* and the track 102, which thereby serves to retain the primary pusher 106*a* in the forward position when the actuator 184*a* is biased to the retracted position (FIG. 17). Consequently, the second end 228 of the actuator 184*a* and the grip 230 are retracted back into the channel 140 of the track for subsequent use. The actuator 184*a* may be used repeatedly used by a user to ensure that product inventory remains consolidated at the forward-most portion of the merchandising system 100.

While the pusher system 110*a* of FIGS. 17-20 is provided as a passive pusher system 110*a*, it should appreciated that any one of the features of the pusher system 110*a* provided in FIGS. 17-20 could be incorporated into the actively biased system shown in FIGS. 1-16. For example, the primary pusher 106 could be replaced with the primary pusher 106*a* and the retraction member 186 could be connected to the primary pusher 106*a* to bias the primary pusher 106*a* in the first direction D1 towards the second end 114. Likewise, the secondary pusher 182 and/or the actuator 184 could be replaced with the secondary pusher 182*a* and/or the actuator 184*a*.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed herein could be termed a second element, component, region, layer or section without departing from the teachings of the example configurations.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A merchandising system comprising:

a track extending from a first end to a second end and including a front stopper fixed at the first end;

a primary pusher slidably attached to the track between the front stopper and the second end and operable to translate along the track relative to the front stopper; and a secondary pusher slidably attached to the track between the primary pusher and the second end and operable to translate along the track relative to the front stopper to bias the primary pusher towards the first end.

2. The merchandising system of claim 1, further comprising an actuator operable to bias the secondary pusher along the track.

3. The merchandising system of claim 2, wherein the actuator is connected to the secondary pusher and includes a grip disposed at the first end of the track.

4. The merchandising system of claim 2, wherein the actuator is received within the track.

5. The merchandising system of claim 4, wherein the actuator extends between the track and the primary pusher.

6. The merchandising system of claim 1, wherein the primary pusher is operable to translate along the track independently from the secondary pusher.

7. The merchandising system of claim 1, further comprising a retraction member operable to continuously bias the secondary pusher towards the second end of the track.

8. The merchandising system of claim 7, wherein the retraction member includes a spring having a first end attached to the secondary pusher and a second end attached to the track.

9. The merchandising system of claim 8, wherein the retraction member includes a stanchion attached to the track, the second end of the spring being attached to the stanchion.

10. The merchandising system of claim 1, wherein the front stopper includes a stopper base that is coupled to the first end of the track and a stopper wall that extends in a transverse direction from the stopper base to provide a barrier at the first end of the track.

11. A merchandising system comprising:

a track extending from a first end to a second end and including a stopper wall fixed at the first end;

a primary pusher slidably attached to the track between the stopper wall and the second end and including a front pusher surface facing the stopper wall, wherein a product receiving area is defined by a length between the front pusher surface and the stopper wall;

a secondary pusher slidably attached to the track between the primary pusher and the second end and operable to translate along the track relative to the front stopper to bias the primary pusher towards the first end; and an actuator disposed at the first end of the track and operable to selectively bias the primary pusher along the track between the stopper wall and the second end.

12. The merchandising system of claim 11, wherein the actuator includes a grip disposed at the first end of the track.

13. The merchandising system of claim 11, wherein the actuator is received within the track.

14. The merchandising system of claim 11, wherein the actuator extends between the track and the primary pusher.

15. The merchandising system of claim 11, wherein the primary pusher is operable to translate along the track independently from the actuator.

16. The merchandising system of claim 11, further comprising a retraction member operable to continuously bias the actuator to a retracted position within the track.

17. The merchandising system of claim 16, wherein the retraction member includes a spring having a first end attached to the actuator and a second end attached to the track.

18. The merchandising system of claim 17, wherein the retraction member includes a stanchion attached to the track, the second end of the spring being attached to the stanchion.

19. The merchandising system of claim 11, further including a stopper base coupled to the first end of the track, the stopper wall coupled to and extending in a transverse direction from the stopper base to provide a barrier at the first end of the track.

* * * * *